United States Patent [19]

Spevak

[11] 4,339,164

[45] Jul. 13, 1982

[54] ARTICLE SUPPORTING ASSEMBLY

[75] Inventor: Stephen T. Spevak, Germantown, Md.

[73] Assignee: Potomac Applied Mechanics, Inc., Bethesda, Md.

[21] Appl. No.: 174,699

[22] Filed: Aug. 1, 1980

Related U.S. Application Data

[60] Division of Ser. No. 38,719, May 14, 1979, Pat. No. 4,286,832, which is a continuation-in-part of Ser. No. 907,321, May 18, 1978, Pat. No. 4,170,392.

[51] Int. Cl.[3] ..... A47B 97/00; A47B 81/00

[52] U.S. Cl. ..... 312/283; 190/16; 206/373; 211/169; 223/107; 312/DIG. 33; 312/305

[58] Field of Search ..... 312/DIG. 33, 280, 138 A, 312/283, 285, 197, 202, 204, 305, 244; 206/372, 373; 190/16; 211/169; 223/107, 108; 220/23

[56] References Cited

U.S. PATENT DOCUMENTS 620,013 2/1899 Barnes ..... 312/209

2,589,370 3/1952 Grennan ..... 312/248

FOREIGN PATENT DOCUMENTS 708608 7/1931 France ..... 312/283

*Primary Examiner*—Alexander Grosz

*Attorney, Agent, or Firm*—Cushman, Darby & Cushman

[57] ABSTRACT

An article supporting assembly is provided that allows quick retrieval of articles mounted thereby, yet makes maximum utilization of the space occupied by the assembly for supporting articles. A center structure, at least two cover plates, and article supporting structures formed on at least one of the center structure and the cover plates are provided. At least two spanners are provided with first hinges for connecting one cover plate to one spanner, and the other cover plate to the other spanner so that the cover plates are pivotal with respect to the spanners, and second hinges for connecting the spanners to the center structure so that the spanners are pivotal with respect to the center structure. The center structure is mounted on a base and/or top of a housing so that it is pivotal with respect to the housing. The spanners, cover plates, and center structure may take a wide variety of forms.

23 Claims, 13 Drawing Figures

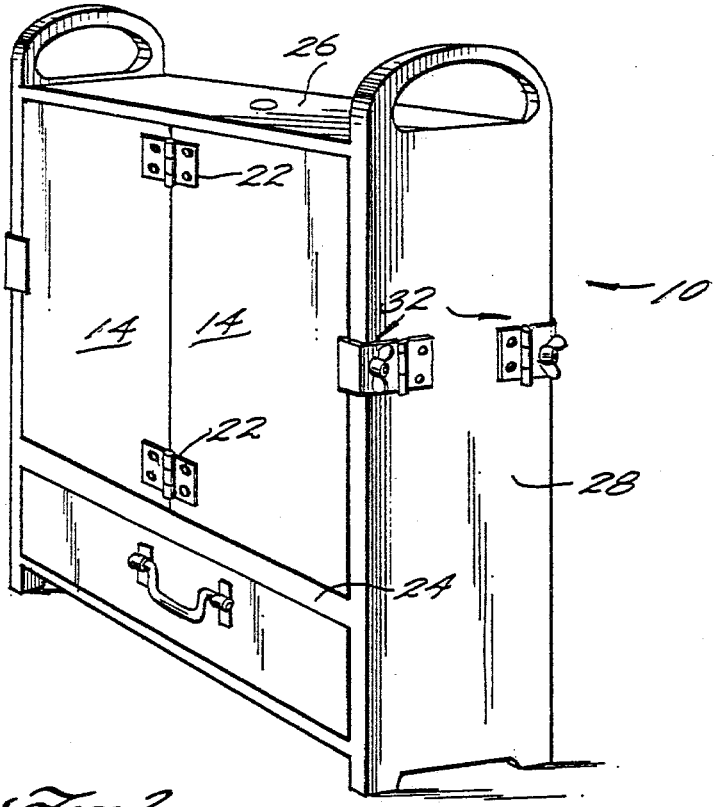
Fig. 1
Fig. 2
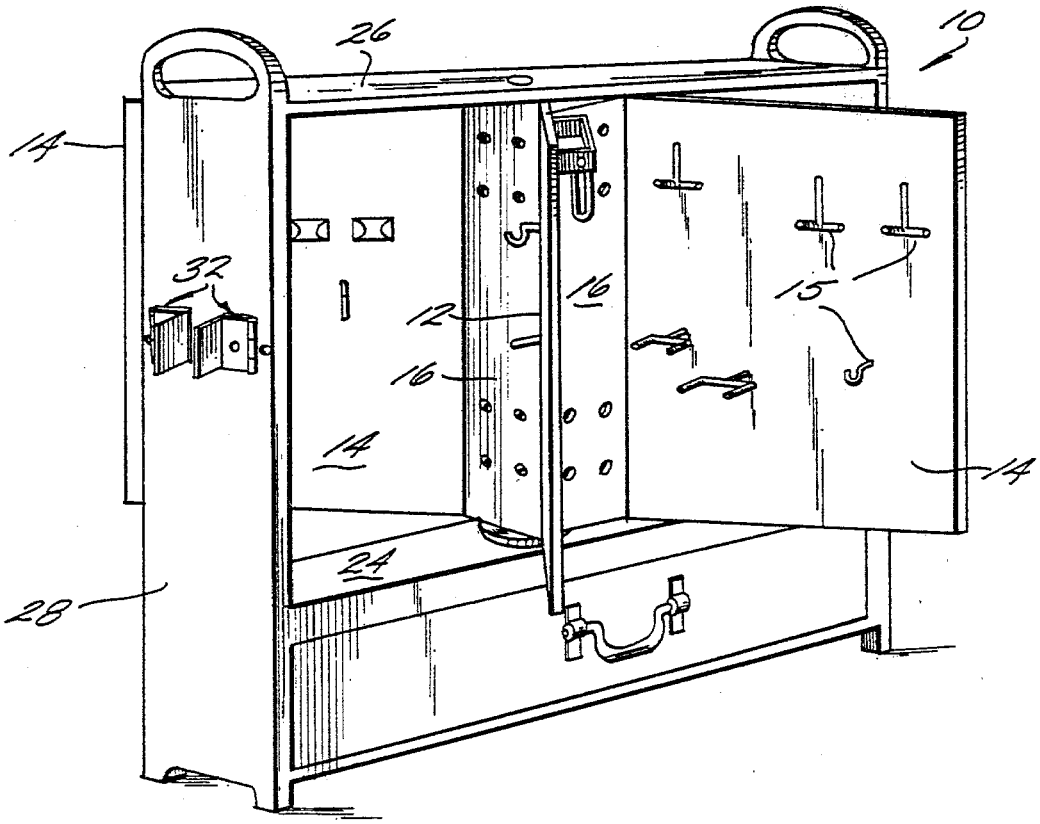

ARTICLE SUPPORTING ASSEMBLY

CROSS REFERENCE TO RELATED APPLICATIONS

This application is a division of application Ser. No. 38,719 filed May 14, 1979, now U.S. Pat. No. 4,286,832, which in turn is a continuation-in-part of application Ser. No. 907,321 filed May 18, 1978, now U.S. Pat. No. 4,170,392.

BACKGROUND AND SUMMARY OF THE INVENTION

There are a wide variety of commercially available tool boxes, display kits, sample cases, sewing boxes, point of purchase display racks, and the like for the convenient mounting of articles to be displayed or utilized. Oftentimes, in such prior commercially available constructions, however, inefficient use is made of the space available, and it is difficult to readily discern and/or remove all of the individual articles contained by the assembly.

According to the present invention, an article supporting assembly is provided that makes maximum use of the available space and is constructed to support all of the articles associated therewith in a manner such that they may be readily seen and removed. The number of uses of the assembly according to the invention is virtually limitless, it being useful as a tool box, display kit, sample case, sewing box, point of purchase display rack, spice rack, support within a kitchen or work cabinet, etc.

According to the basic structure of the present invention, an article supporting assembly is provided that comprises a center structure, at least two cover plates, and article supporting structures formed on at least one of the center structure and the cover plates. At least two spanners are provided, and first hinges are provided for connecting one cover plate to one spanner, and the other cover plate to the other spanner so that the cover plates are pivotal with respect to the spanners. Second hinges connect the spanners to the center structure so that the spanners are pivotal with respect to the center structure. A wide variety of shapes and constructions for the center structure, cover plates, and spanners allows a wide variety of uses of the assembly. For instance, the cover plates can be hinged together by third hinges. The spanners may be provided by prisms, which may support drawers or like article receiving structures. A removable cover can be provided for the entire assembly, and preferably the center structure is mounted for rotation with respect to a housing base and/or top component. A plurality of cover plates may be pivoted to each spanner, and the center structure itself may comprise two parts which are pivotal together.

It is the primary object of the present invention to provide an article supporting assembly that makes maximum use of the space occupied thereby, yet supports each article in a manner so that it may be readily seen and removed. This and other objects of the invention will become clear from an inspection of the detailed description of the invention, and from the appended claims.

BRIEF DESCRIPTION OF THE DRAWINGS

FIGS. 1 and 2 are perspective views of a first embodiment of the article supporting assembly according to the invention shown in closed and open positions respectively;

DETAILED DESCRIPTION OF THE DRAWINGS

Figure 3:
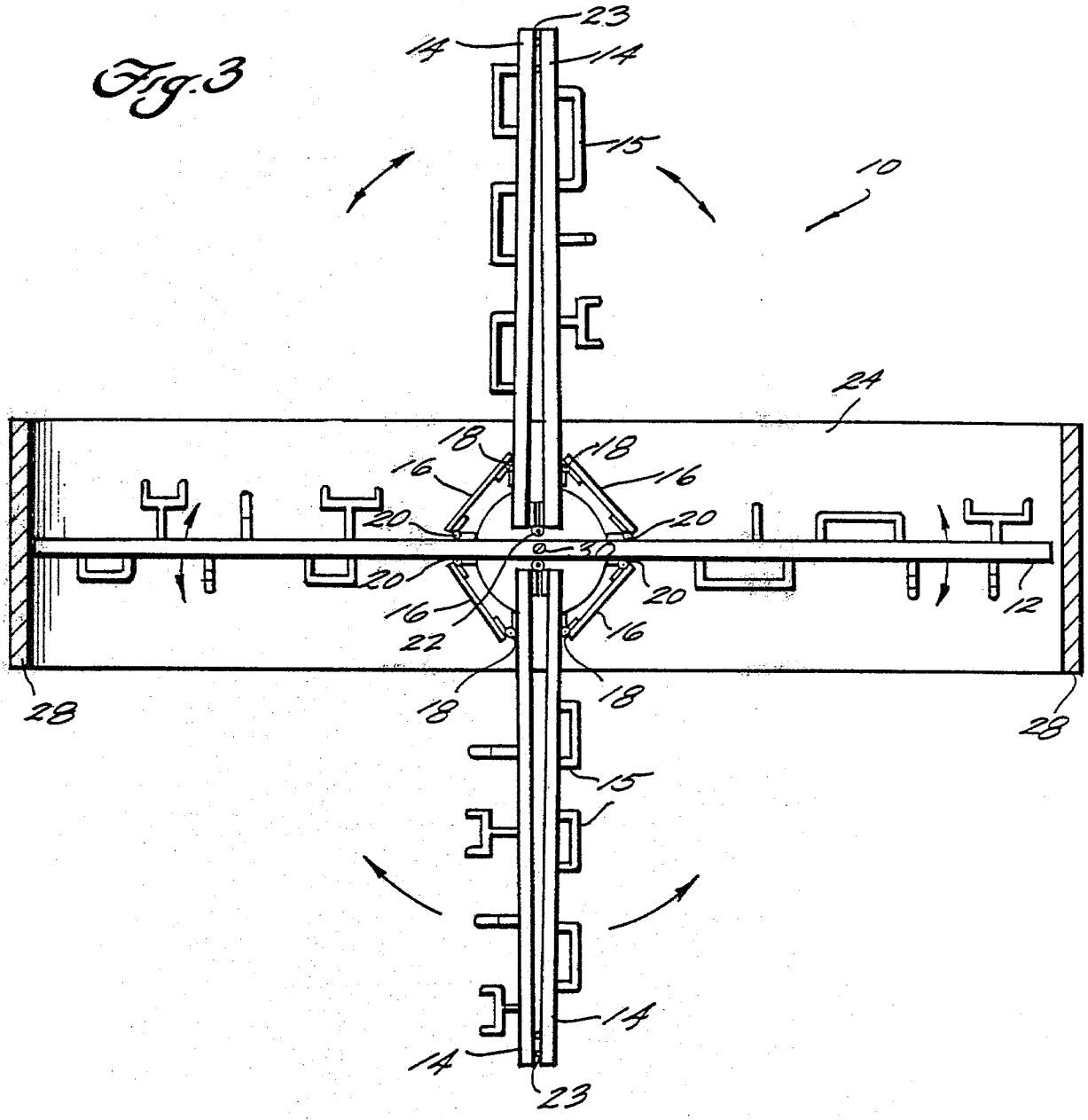
FIG. 3 is a top view, with housing top removed, of the first embodiment.

In the drawings like reference numerals are utilized for like structures in the various embodiments. For instance, the reference numeral 12 in the first embodiment refers to the center structure, while the reference numeral 112 refers to the center structure in the second embodiment, reference numeral 212 refers to the center structure in the third embodiment, etc. While the terms "plate" and "spanner" are sometimes used to describe various components, such terms should be interpreted broadly, and are not restricted to only thin, completely flat, continuous members. For instance, such members may be segmented, have a curvature, and have different shapes than illustrated in the drawings, the representations in the drawings being only exemplary. Similarly, while the housing components are illustrated as flat, they may be curved, bifrucrated, or otherwise shaped and dimensioned.

The first embodiment of the assembly according to the invention as shown generally at 10 in FIGS. 1–3; the assembly 10 includes a center structure 12 (e.g. a center plate), at least two cover plates 14, and article supporting structures 15. At least two spanners 16 are provided. First hinges 18 connect the cover plates 14 to the spanners 16 so that the cover plates 14 are pivotal with respect to the spanners 16, and second hinges 20 connect the spanner 16 to the center structure 12 so that the spanners are pivotal with respect to the center structure 12. Third hinges 22 are provided for connecting the cover plates 14 together along adjacent edges thereof for pivotal movement with respect to each other and fastening means, such as magnets 23, may be provided for holding the cover plates 14 together in the open position (see FIG. 3).

A stationary base member 24 preferably is provided in a plane perpendicular to the plane of the center plate 12. Also, cover means are provided such as a housing top 26 and housing sides 28, to form an enclosed area. Mounting means are provided for mounting the center plate 12 for rotation with respect to the base member 24 and/or the top 26, about an axis perpendicular to the base member 24 and passing substantially through the center of the center plate 12. Such means may comprise a shaft 30 mounted in bearings in the base member 24 and/or at the top 26, a Lazy Susan arrangement, or the like. Latching means 32 or the like (see FIGS. 1 and 2) may be provided on the housing sides 28 for releasably holding the cover plates 14 in the closed position (see FIG. 1).

Figure 4:
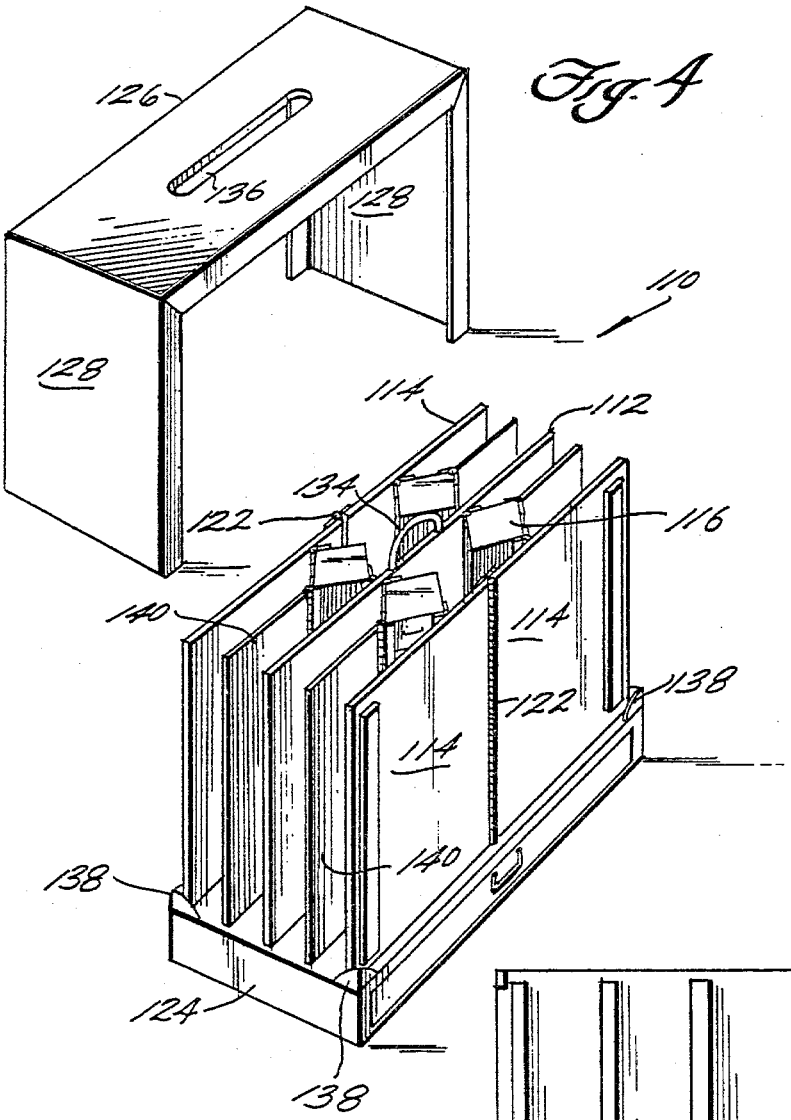
FIG. 4 is an exploded perspective view of a second exemplary embodiment of the assembly according to the present invention.
Figure 5:
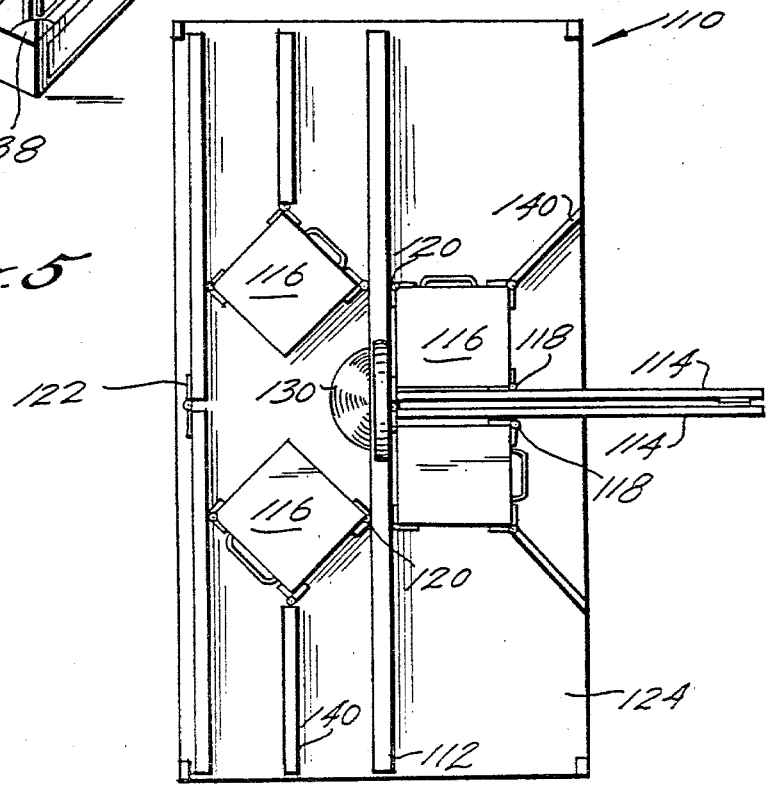
FIG. 5 is a top plan view of the second embodiment.

The second embodiment of the assembly according to the present invention is illustrated generally at 110 in FIGS. 4 and 5, this embodiment being especially suited for a point of purchase display rack. In this embodiment, a handle 134 is provided on top of the center plate 112, and the housing top 126 is integrally connected with the sides 128, such an integral structure being removable from cooperation with the base member 124 and the rest of the assembly, as shown in FIG. 4. Means defining an opening 136 are provided in the top 126 to allow the passage of the handle 134 therethrough. Also, projections 138 may be formed on the base member 124 for holding the cover plates 114 in the closed position, the cover plates 114 mounted by hinges 122, 120, 118 so that they may be moved slightly upwardly for the user to ride over the projections 138 to be moved to the open position (see the right half of FIG. 5). In this embodiment, the means 130 for mounting the center structure 112 for rotation is provided just on the base member 124.

Also, in the assembly 110, the spanners 116 preferably comprise prisms, with the first and second hinges 118, 120 being formed along opposed edges of each of the prisms 116, as illustrated in FIGS. 4 and 5. Preferably, the prisms 116 are hollow and article supporting drawers may be formed in the prisms. Additionally, an article supporting accessory plate 140 may be operatively attached to an edge of each of the prisms 116 inbetween the edges along which the first and second hinges 118, 120 are formed, and the accessory plates 140 may be pivotally attached to the prisms 116 if desired. All pivots 118, 120, etc., may be provided by piano hinges, pieces or tape, flexible hinges, or any other type of conventional hinge mechanisms.

Figure 6:
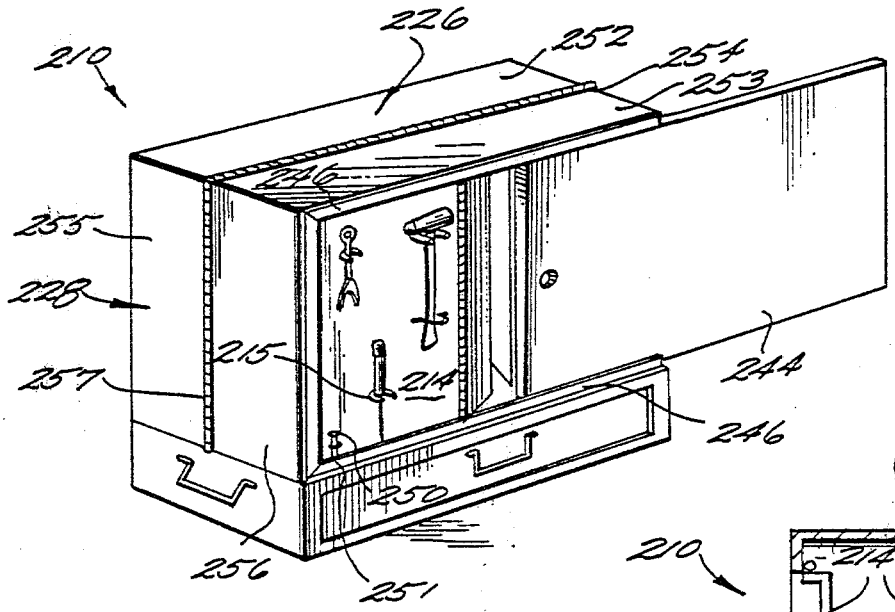
FIG. 6 is a perspective view of a third embodiment of the assembly according to the present invention.
Figure 7:
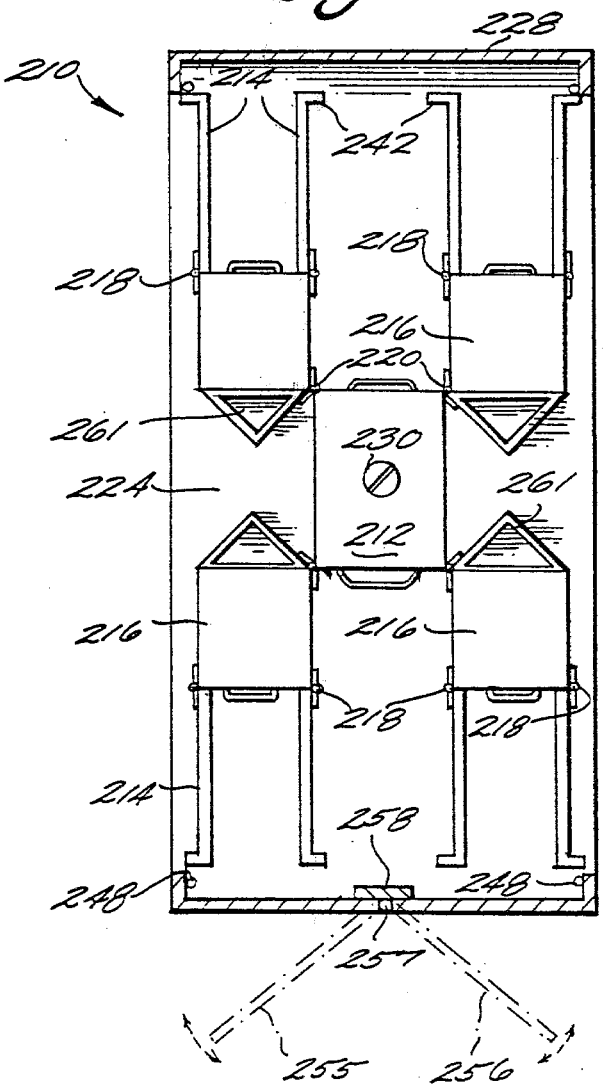
FIGS. 7 and 8 are top plan views, with the housing top removed, of the third embodiment shown in closed and open positions respectively.
Figure 8:
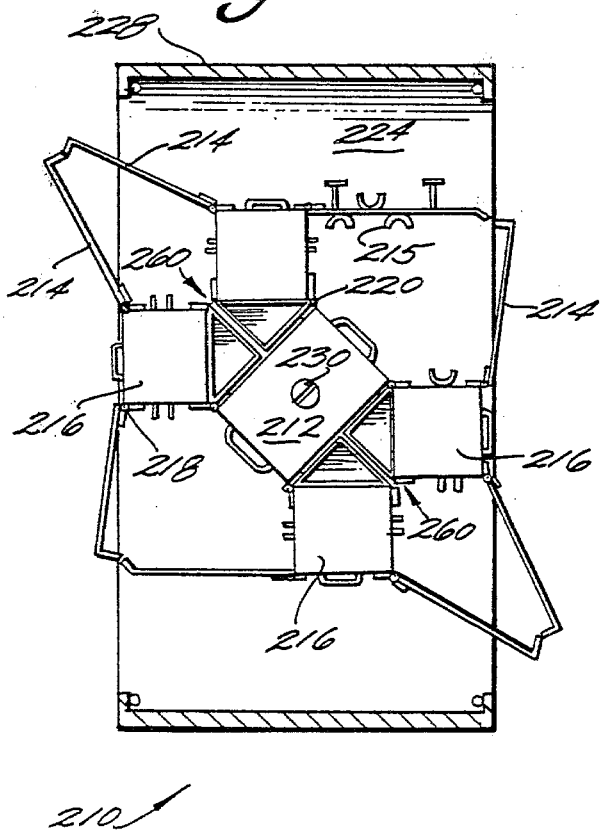

The third embodiment according to the present invention is shown generally at 210 in FIGS. 6–8. This embodiment is especially adapted for use as a tool box or for a like structure where a large number of different article supporting surfaces are desirable. In this embodiment, the center structure 212 comprises a prism, and the spanners 216 each also comprise prisms, the second hinges 220 being formed along cooperating edges of the center structure prism 212 and the spanner prisms 216. The prisms 212, 216 can be hollow and include article supporting drawers or the like.

In order to provide a maximum number of support surfaces, a plurality of cover plates 214 can be associated with each spanner 216, such as a pair of cover plates 214 associated with each spanner 216 as illustrated in FIGS. 7 and 8. The first hinges 218 are thus formed along two cooperating edges of the spanner prisms 216 to pivotally attach the pair of cover plates to each prism 216. Magnets or like releasable attaching structures are provided along the distal edges 242 of the cover plates 214, to releasably attach such cover plates together in the open position, as illustrated in FIG. 8. When the cover plates are attached to each other in this manner, the cover plates 214 associated with the same spanner 216 make an angle of greater than 90° with respect to each other, as clearly illustrated in FIG. 8, which allows ready access to the article supported thereby. Ready access can also be gained to the interiors of the cover plates by merely pivoting the plates 214 about the pivots 218 to release attachment by the magnets or the like provided in the distal edges 242.

In order to completely close up the assembly so that no articles are seen in the closed position, front and back panels may be provided, such as the front panel 244 illustrated in FIG. 6. Such front back panels may be pivotally mounted to the base 224 or the top 226, or—as illustrated in FIG. 6—may be mounted for slideable movement along guide tracks 246 with respect to the top 226 and sides 228 and base 224 of the assembly 210. Additionally, means are provided for releasably latching the cover plates 214 to at least one of the cover means (top 226 or sides 228) or the base member 224. Such releasable latching means may take a wide variety of forms, such as cooperating magnets formed on the distal edges 242 of the cover plates 214, and formed at 248 along the housing sides 228 (see FIG. 7), or slidable pins 250 may be mounted on the cover plates 214 to slide into engagement with openings 251 formed in the base member 224, as shown in FIG. 6.

Additionally, in any of the embodiments the top 226 and/or sides 228 may be formed of plate members pivoted together for pivotal movement with respect to each other and the rest of the assembly. For instance, in FIG. 6 the top 226 is shown formed by two component portions 252, 253 which are pivotally mounted together by a hinge 254 so that they can pivot upwardly with respect to the base member 224 and the rest of the assembly. Of course an interior rib must be provided for supporting the hinge 254, which is operatively attached to the stationary base 224. As shown in FIGS. 6 and 7, the sides 228 of the housing may be formed by component portions 255 and 256 which are pivotally mounted by a hinge 257, which hinge is also operatively connected to a rib member 258 or the like which is operatively connected to the base 224.

The spanner members 216 are provided with structures for latching them in the closed position (FIG. 8), such as cooperating snaps or magnets (see 260 in FIG. 8) formed on adjacent spanners 216. When it is desirable to provide the right-triangle support it is desirable to provide the right-triangle support extensions 261 (see FIG. 7) extending from the spanner prisms 216 to support them in the position illustrated in FIG. 8, with appropriate choice of the latching means 260, and with appropriate dimensioning of the spanners 216, such supports 261 may be eliminated if desired.

Figure 9:
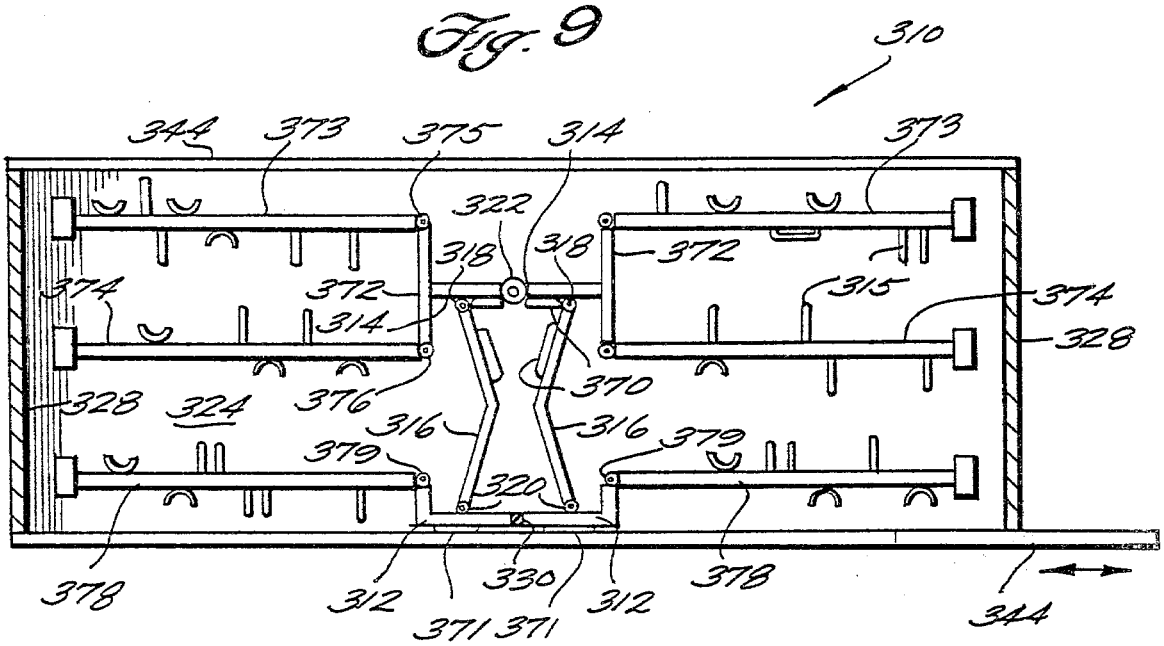
FIGS. 9 and 10 are top plan views, with the housing top removed, of a fourth exemplary embodiment according to the present invention shown in closed and open positions respectively.
Figure 10:
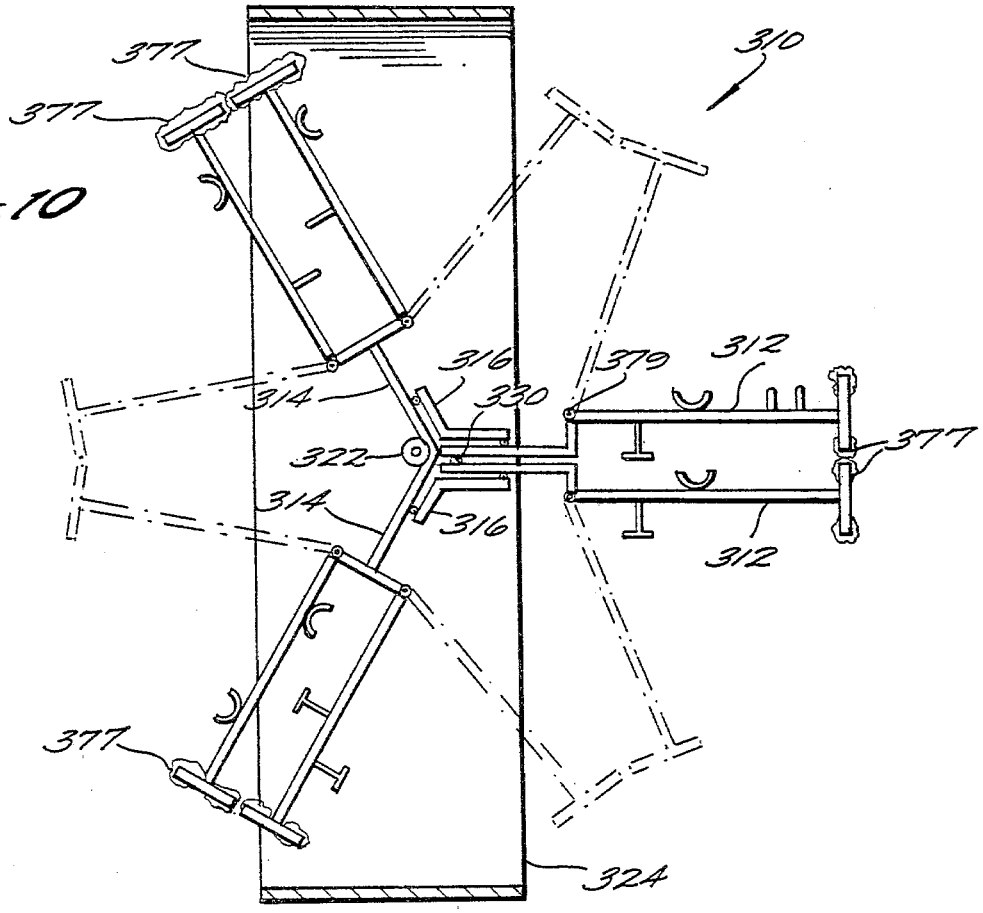

A fourth embodiment of the invention is shown generally at 310 in FIGS. 9 and 10. In this embodiment, the center structure 312 is provided as a plate having two plate halves, with means 330 for mounting the plate halves for pivotal movement with respect to each other about an axis parallel to the axes of the first and second hinges 318, 320. The pivot mounting means 330 also preferably comprises the mounting means for mounting the center structure 312 for rotation with respect to the base member 324.

In the embodiment of FIGS. 9 and 10, the spanners 316 are provided as a pair of substantially rigid members having a pair of legs that make an angle of about 120° with respect to each other, the legs of each of said spanners opening away from the legs of the other spanner as illustrated in FIG. 9. Attaching means (such as hook and loop type fasteners, such as the ones sold under the trademark "VELCRO", formed in strips 370) are provided on the cover plates 314 and the spanners 316 for holding them together in the open position (see FIG. 10), while hook and loop type fastener strips 371, or like attaching structures (e.g. magnets) are provided on the two halves of the center structure 312 for holding them together in the open position (see FIG. 10).

In the FIGS. 9 and 10 embodiment, each of the cover plates 314 comprises a bifrucated member having a base portion 372 and first and second plates 373, 374, with hinges 375, 376 or like means for mounting the plates 373, 374 for pivotal movement with respect to the base portions 372 about axes parallel to the axes of the first and second hinges 318, 320. Fastening means, such as strips of hook and loop type fastener 377, are preferably formed on the ends of each of the plates 373, 374 distal from the pivotal mounting means 375, 376, and like fastening means 377 are formed on the distal portions of the center plate 312 half. The center plate 312 halflikewise comprise extensions components 378 which are pivotally mounted, as at 379, to the portions of the plates connected by the hinge means 330.

With the assembly 310, it is possible to mount the cover plates 314 and the center structure 312 so that the different faces thereof may alternately be moved to the outside for ready accessibility as illustrated by the dotted line and solid line positions in FIG. 10. Additionally, in this embodiment the rotatable mounting means 330 is mounted closer to one side of the base 324 than the other, so that the article supporting plates extending outwardly through the front (side closest to the mounting means 330) extend almost entirely outwardly of the base member 324 (and sides 328 and cooperating top). In this embodiment, as in the embodiment 210, sliding or pivotal front and back panels 344 may be provided for closing up the assembly.

Figure 11:
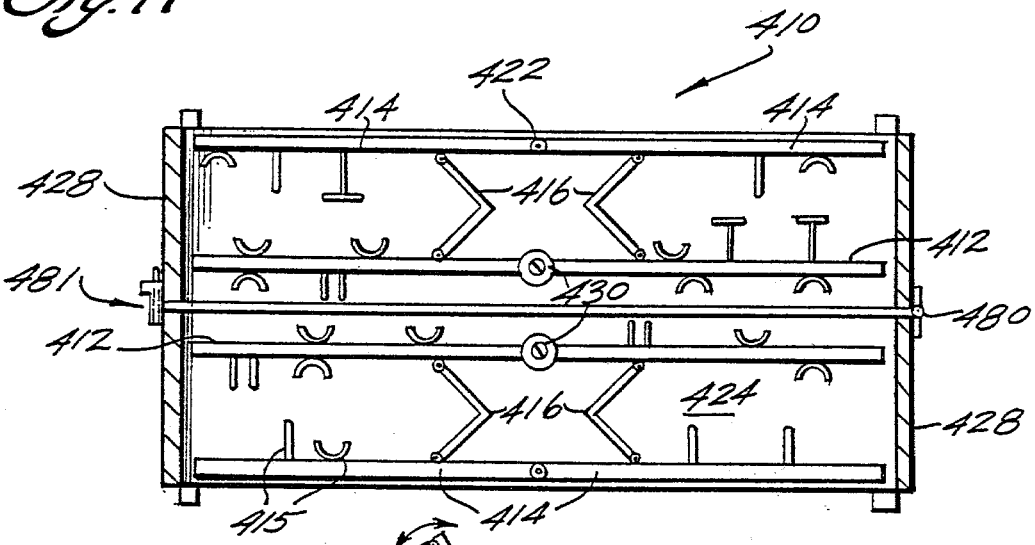
FIG. 11 is a top plan view, with housing top removed, of a fifth embodiment of the assembly according to the present invention shown in closed position.
Figure 12:
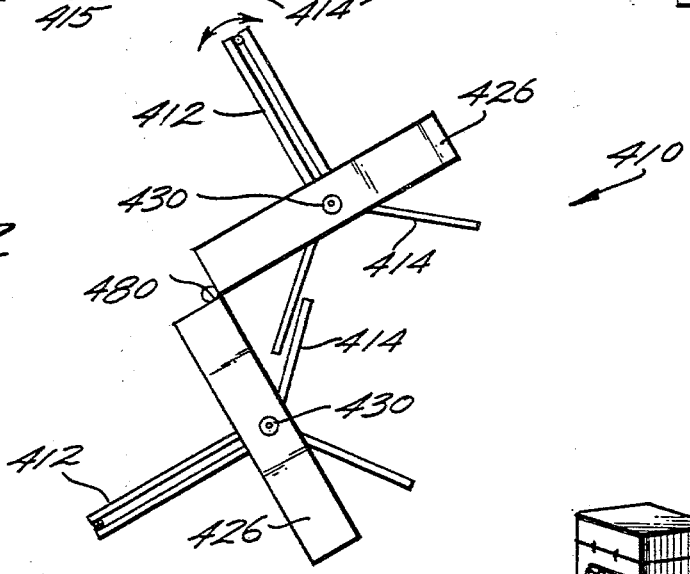
FIG. 12 is a top plan view of the fifth embodiment shown in open position.

The fifth embodiment according to the present invention, shown generally at 410 in FIGS. 11 and 12, is similar to the embodiment 310 except that the cover plates 414 are not bifrucated, nor are the center plates 412 formed with accessory pivotal plates (such as the plates 378). Additionally, in this embodiment the first and second substantially identical housings are provided pivotally mounted together such as by hinge 480, which housings are movable from the closed position wherein they are latched together by conventional latching means 481 (see FIG. 11) to an open position (see FIG. 12) wherein access is provided to the interiors of both housings. In the embodiment 410, front and back panels (such as panels 344) are not necessary since the cover plates 414 form the exterior of the housing, yet again all available interior space is utilized for supporting articles.

Figure 13:
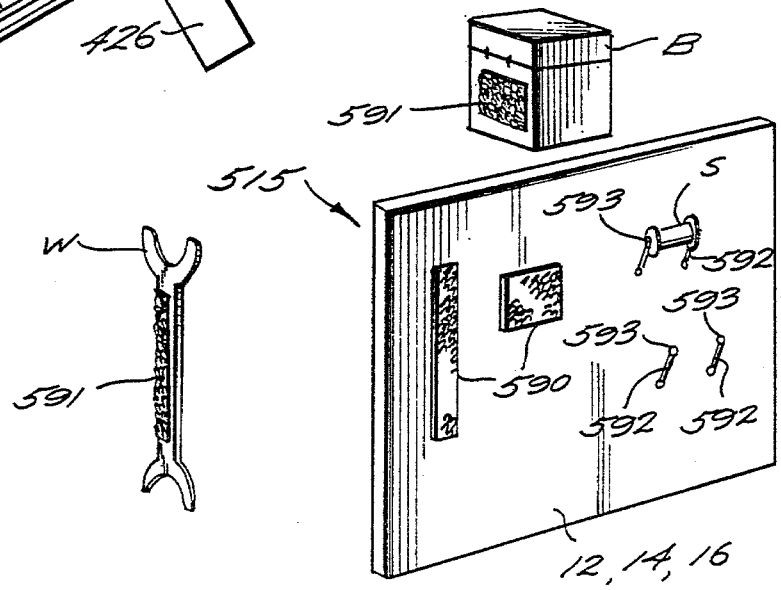
FIG. 13 is a detailed perspective view of exemplary article supporting structures that may be utilized according to the present invention.

Any type of conventional article supporting arrangements may be provided as the supporting arrangements 15, 115, 215, 315, or 415, however especially suitable article supporting means according to the present invention are shown generally at 515 in FIG. 13. One variation of such means 515 comprises a plurality of hook and loop type fastener strips 590 formed on a center plate 12, cover plate 14, spanners 16, or the like, with the cooperating hook and loop type fastener portions 591 formed on the article to be supported, such as a wrench W or a pivotal top box B for holding pins, buttons, screws, or the like. Another variation the means 515 can take comprises a pair of rods 592 with spherical ends 593 thereof that are distal from the assembly component (e.g. plate 12) to which the rods 592 are mounted, the spherical ends 593 being mounted so that they are capable of releasably mounting a spool S—such as a spool of thread—therebetween. For instance, the rods 592 may be somewhat flexible, or their connection to the component 12 or the like may allow for slight flexing so that they can be moved along the axis of a spool S or the like to be mounted thereby.

In all the embodiments according to the present invention, in one position the assembly is mounted for easy transport with the articles mounted thereby taking up virtually the entire interior volume defined by the assembly, yet the assembly is movable to an open position wherein the articles supported thereby are readily seen and retrieved. Simple rotation of the article support allows any article supported thereby to be moved into a position to be seen and removed by the user.

While the invention has been herein shown and described in what is presently conceived to be the most practical and preferred embodiments thereof, it will apparent to those of ordinary skill in the art that many modifications may be made thereof within the scope of the invention, which scope is to be accorded the broadest interpretation of the appended claims so as to encompass all equivalent structures and assemblies.

What is claimed is:

1. An article supporting assembly comprising a center structure; at least two cover plates; article supporting structures formed on at least one of the center structure and the cover plates; at least two spanners comprising hollow prisms having article supporting drawers formed therein; first hinges for connecting the cover plates to the spanner prisms so that the cover plates are pivotal with respect to the spanner prisms; second hinges for connecting the spanner prisms to the center structure so that the spanner prisms are pivotal with respect to the center structure; and said first and second hinges being formed along opposed edges of each of said spanner prisms.

2. An assembly as recited in claim 1 wherein said center structure comprises a center plate; and further comprising a third hinge for connecting said cover plates together along adjacent edges thereof for pivotal movement with respect to each other.

3. An article supporting assembly comprising a center structure; at least two cover plates; article supporting structures formed on at least one of the center structure and the cover plates; at least two spanner prisms; first hinges for connecting the cover plates to the spanner prisms so that the cover plates are pivotal with respect to the spanner prisms; second hinges for connecting the spanner prisms to the center structure so that the spanners are pivotal with respect to the center structure; said first and second hinges being formed along opposed edges of each of said spanner prisms; and an article-supporting accessory plate operatively attached to an edge of each of said prisms in between the edges along which said first and second hinges are formed.

4. An assembly as recited in claim 3 wherein said center structure comprises a center plate; and further comprising a third hinge for connecting said cover plates together along adjacent edges thereof for pivotal movement with respect to each other.

5. An assembly as recited in claims 1 or 3 wherein said center structure comprises a hollow prism having article-supporting drawers associated therewith, and wherein said second hinges are formed along cooperating edges of said center structure prism and said spanner prisms.

6. An article supporting assembly comprising a center structure; at least two cover plates; article supporting structures formed on at least one of the center structure and the cover plates; at least two spanners, first hinges for connecting the cover plates to the spanners so that the cover plates are pivotal with respect to the spanners; and second hinges for connecting the spanners to the center structure so that the spanners are pivotal with respect to the center structure; a stationary base member; and cover means for covering the top and both sides of said center structure to form an enclosed area, and comprising a removable cover member including a top planar surface, and opposed side planar surfaces substantially perpendicular to said top planar surface and movable to and from operative engagement with said base member.

7. An assembly as recited in claim 6 further comprising a handle operatively attached to the top of said center structure and extending upwardly therefrom, and means defining an opening in said removable cover member to allow passage of said handle through said opening.

8. An assembly as recited in claims 6 or 7 further comprising means for mounting said center structure for rotation with respect to said base member about an axis substantially perpendicular to said base member.

9. An assembly as recited in claim 8 wherein said center structure comprises a center plate; and further comprising a third hinge for connecting said cover plates together along adjacent edges thereof for pivotal movement with respect to each other.

10. An assembly as recited in claim 6 wherein said at least two cover plates comprises four cover plates; and wherein said at least two spanners comprises four spanners, a pair of cover plates and spanners being disposed in association with and on opposite faces of said center plate.

11. An article supporting assembly comprising a center structure comprising a prism; at least two cover plates; article supporting structures formed on at least one of the center structure and the cover plates; at least two spanners comprising prisms; first hinges for connecting the cover plates to the spanners so that the cover plates are pivotal with respect to the spanners; second hinges formed along cooperating edges of said center structure prism and said spanner prisms for connecting the spanners to the center structure so that the spanners are pivotal with respect to the center structure; a stationary base member disposed in a plane perpendicular to the direction of elongation of said prisms; means for mounting said center prism for rotation with respect to said base member about an axis perpendicular to said base member and passing through said center prisms; cover means for covering the top and both sides of said assembly to form an enclosed area; and means for releasably attaching each cover plate to another cover plate associated with an adjacent spanner so that when said cover plates are attached to each other, the cover plates associated with the same spanner make an angle of greater than 90° with respect to each other.

12. An assembly as recited in claim 11 wherein said at least two spanners comprises four spanners, and wherein said center prism includes four edges, said second hinges for pivotally connecting a spanner to each center prism edge; and wherein said at least two cover plates comprises eight cover plates, each spanner prism comprising at least three edges and said first hinges pivotally connecting two cover plates to two edges of each spanner prism, and said second hinges pivotally connecting a third edge of each spanner prism to said center prism.

13. An assembly as recited in claim 12 wherein each spanner comprises a face disposed between the cover plates associated with that spanner, and wherein drawers are provided in each said spanner face.

14. An assembly as recited in claim 11 further comprising a pair of slidable plates mounted for slidable movement with respect to said cover means for releasably covering the front and back of said assembly.

15. An assembly as recited in claim 11 further comprising means for releasably attaching said spanner prisms together in a position wherein the abut said center prism and cannot pivot about said second hinges with respect to said center prism.

16. An assembly as recited in claim 11 further comprising means for releasably latching said cover plates to at least one of said cover means and said base member.

17. An assembly as recited in claim 11 wherein said center prism is quadrilateral in cross-section and wherein said spanner prisms each have a quadrilateral core.

18. An article supporting assembly comprising a center structure comprising a plate including two plate halves; at least two cover plates; article supporting structures formed on at least one of the center structure and the cover plates; at least two spanners comprising a pair of substantially rigid member each having a pair of legs that make an angle of about 120° with respect to each other, said legs of each of said spanners opening away from the legs of the other spanner; first hinges for connecting the cover plates to the spanners so that the cover plates are pivotal with respect to the spanners; second hinges for connecting the spanners to the center structure so that the spanners are pivotal with respect to the center structure; and means for mounting said plate halves for pivotal movement with respect to each other about an axis parallel to the axes of said first and second hinges.

19. An assembly as recited in claim 18 further comprising a base member for supporting said assembly, and wherein said means for mounting said plate halves of said center structure for pivotal movement with respect to each other further comprises means for mounting said center structure, spanners, and cover plates for rotatable movement with respect to said base member.

20. An article supporting assembly comprising a center structure comprising a plate including two plate halves; at least two cover plates; article supporting structures formed on at least one of the center structure and the cover plates; at least two spanners; first hinges for connecting the cover plates to the spanners so that the spanners are pivotal with respect to the center structure; means for mounting said plate halves for pivotal movement with respect to each other about an axis parallel to the axes of said first and second hinges; and wherein each of said cover plates comprises a bifrucated member having a base portion, first and second plates, and means for mounting said first and second plates for pivotal movement with respect to each other and with respect to said base portion about axes parallel to the axes of said first and second hinges.

21. An assembly as recited in claim 20 further comprising fastening means formed on the ends of each of said first and second plates distal from said pivotally mounting means, and fastening means formed on the ends of said center structure plate halves distal from the pivotal mounting means therefor.

22. An article supporting assembly comprising a center structure comprising a plate including two plate halves; at least two cover plates; article supporting structures formed on at least one of the center structure and the cover plates; at least two spanners; first hinges for connecting the cover plates to the spanners so that the spanners are pivotal with respect to the center structure; means for mounting said plate halves for pivotal movement with respect to each other about an axis parallel to the axes of said first and second hinges; and a housing for said assembly including a base member, side walls and a top wall, and further comprising a second center structure, spanners, and cover plates, and mounted in a second substantially identical housing; and means for mounting said housing and said second housing for pivotal movement with respect to each other about an axis parallel to the axes of said first and second hinges, and so that said housing and said second housing may be moved into a collapsed position with said center structures thereof adjacent.

23. An assembly as recited in claims 1, 3, 6, 11, 18, 20, or 22 wherein said article supporting structures comprise hook and loop type fasteners attached to said assembly and to an article to be supported thereby.

* * * * *